US009041312B2

(12) United States Patent
Zulim et al.

(10) Patent No.: US 9,041,312 B2
(45) Date of Patent: May 26, 2015

(54) LIGHTING CONTROL DEVICE

(75) Inventors: Dalibor Zulim, Conyers, GA (US); Richard L. Westrick, Jr., Social Circle, GA (US); Stephen Haight Lydecker, Snellville, GA (US)

(73) Assignee: ABL IP Holding LLC, Conyers, GA (US)

( * ) Notice: Subject to any disclaimer, the term of this patent is extended or adjusted under 35 U.S.C. 154(b) by 359 days.

(21) Appl. No.: 13/596,768

(22) Filed: Aug. 28, 2012

(65) Prior Publication Data

US 2014/0062338 A1 Mar. 6, 2014

(51) Int. Cl.
*H05B 37/02* (2006.01)
*G05F 1/10* (2006.01)

(52) U.S. Cl.
CPC ..... *H05B 37/0254* (2013.01)

(58) Field of Classification Search
None
See application file for complete search history.

(56) References Cited

U.S. PATENT DOCUMENTS

| | | | | |
|---|---|---|---|---|
| 5,471,119 | A | 11/1995 | Ranganath et al. | |
| 5,694,006 | A * | 12/1997 | Konopka | 315/219 |
| 5,925,986 | A | 7/1999 | Moisin | |
| 6,075,326 | A | 6/2000 | Nostwick | |
| 6,188,183 | B1 | 2/2001 | Greenwood et al. | |
| 6,337,544 | B1 | 1/2002 | Wang et al. | |
| 6,614,192 | B1 * | 9/2003 | Noone et al. | 315/307 |
| 6,667,585 | B2 | 12/2003 | O'Meara | |
| 6,717,374 | B2 | 4/2004 | Krummel | |
| 6,762,569 | B1 | 7/2004 | Holmes et al. | |
| 6,906,476 | B1 | 6/2005 | Beatenbough et al. | |
| 7,151,346 | B2 | 12/2006 | Sanchez | |
| 7,372,216 | B2 | 5/2008 | Liang | |
| 7,385,360 | B2 | 6/2008 | Dluzniak | |
| 7,443,113 | B2 | 10/2008 | Crouse et al. | |
| 7,564,192 | B2 | 7/2009 | Collins et al. | |
| 7,642,735 | B2 | 1/2010 | Gulsen et al. | |
| 7,675,251 | B2 | 3/2010 | Gordin et al. | |
| 7,911,159 | B2 | 3/2011 | Van Casteren et al. | |
| 8,358,078 | B2 * | 1/2013 | Natarelli | 315/209 R |
| 8,593,076 | B2 * | 11/2013 | Veskovic | 315/291 |
| 8,803,432 | B2 * | 8/2014 | Hausman, Jr. | 315/200 R |
| 2003/0127998 | A1 | 7/2003 | Notarianni et al. | |
| 2004/0119423 | A1 | 6/2004 | Yablonowski | |
| 2008/0150451 | A1 | 6/2008 | Gordin | |
| 2008/0258637 | A1 * | 10/2008 | Leung | 315/185 R |
| 2009/0206775 | A1 | 8/2009 | Green et al. | |
| 2010/0237804 | A1 | 9/2010 | Liang | |
| 2011/0057570 | A1 | 3/2011 | Cleland et al. | |
| 2011/0057573 | A1 | 3/2011 | Jutras et al. | |

* cited by examiner

*Primary Examiner* — Crystal L Hammond
(74) *Attorney, Agent, or Firm* — Kilpatrick Townsend & Stockton, LLP

(57) ABSTRACT

A lighting control device can include a control module and a processing module. The control module can provide a driving signal. The driving signal can modify a control voltage on a control interface. The control voltage can control a controllable ballast or driver. The processing module can determine a duty cycle of the driving signal. The control module and the processing module can receive power via the control interface and a power supply on the control device.

24 Claims, 7 Drawing Sheets

LIGHTING CONTROL DEVICE

FIELD OF THE INVENTION

This disclosure relates generally to control devices and more particularly relates to control devices powered from a control interface.

BACKGROUND

Currently available control systems for lighting devices, such as luminaires, include those controllers that support a 0-10 volts ("V") analog control protocol. Currently available control systems are not powered via a control interface, such as a 0-10 V control bus used to provide a control voltage or control signal to, for example, a control input of a controllable ballast or driver for a luminaire. Currently available control systems include additional power sources for powering the components of the control system, thereby increasing the cost and complexity of lighting control systems.

Control systems for lighting devices can also include methods and devices to compensate for lumen depreciation in lighting devices. Lumen depreciation is the reduction of light output over the lifespan of the lighting device. For example, luminaires can reduce light output by 20% or more over their useful lifespan. Previous methods and devices designed to compensate for lumen depreciation may require the incorporation of additional specialized equipment, such as optical or electrical sensors or dedicated external equipment requiring a separate power supply of some kind. The incorporation of additional specialized equipment can increase the costs and complexity involved with compensating for lumen depreciation.

SUMMARY

In some aspects, a lighting control device is provided. The lighting control device can include a control module and a processing module. The control module can provide a driving signal. The driving signal can modify a control voltage on a control interface. The control voltage can control a controllable ballast or driver. The processing module can determine a duty cycle of the driving signal. The control module and the processing module can receive power via the control interface.

These and other aspects, features and advantages of the present invention may be more clearly understood and appreciated from a review of the following detailed description and by reference to the appended drawings and claims.

DETAILED DESCRIPTION

Figure 1:
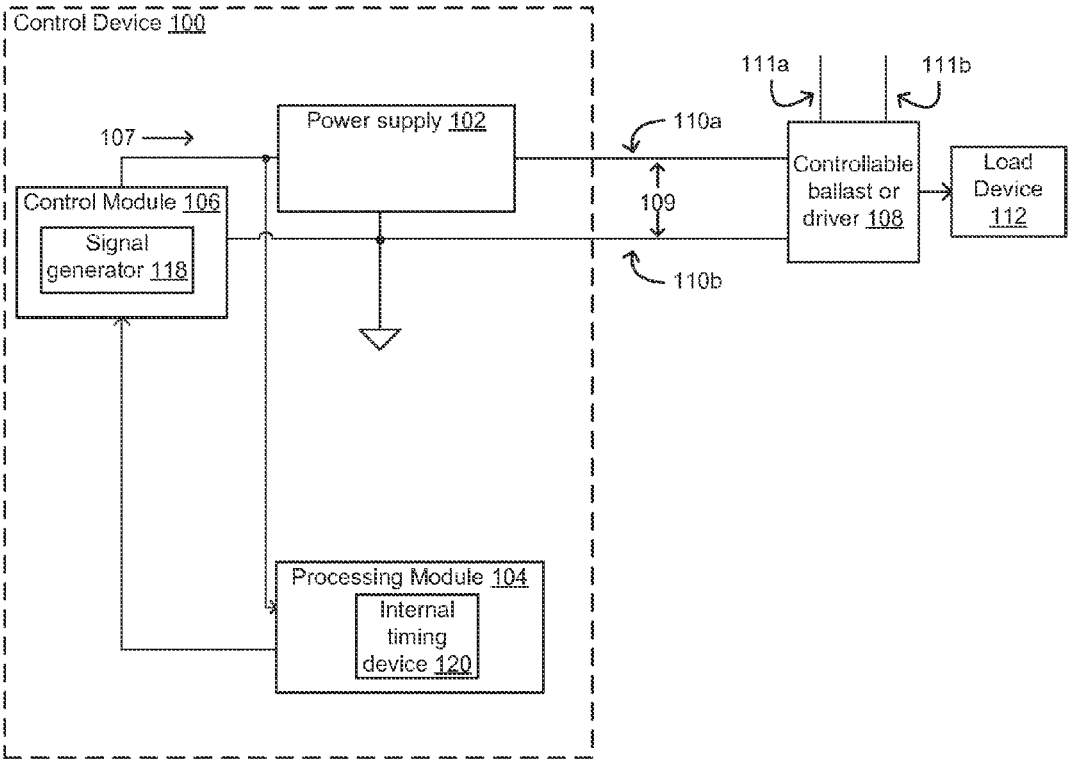
FIG. 1 is a block diagram illustrating an example lighting control device.

Aspects of the present invention provide a lighting control device, also referred to herein as a control device. The lighting control device can include a power supply, a control module, and a processing module. The power supply can provide a control voltage via a control interface, such as 0-10V control bus, to a controllable ballast or driver. The controllable ballast or driver can power a lighting device, such as a lamp or LEDs. The control module can provide a driving signal to the power supply. The driving signal can cause the power supply to load and thereby modify the control voltage on the 0-10 V control bus or other control interface. The processing module can determine a duty cycle of the driving signal. The power supply can provide a regulated, constant voltage for the processing module (e.g, 3.3 V or 5.0 Vdc) from the 0-10 V analog control voltage, thereby obviating the need for a dedicated power supply to provide power to the control device.

For example, the control device can include a regulating device, such as a voltage regulator, for providing a constant voltage to a microprocessor directly from a 0-10 V analog control bus. The constant voltage can be, for example, 3.3 Vdc or 5.0 Vdc. The microprocessor can provide a pulse-width modulation ("PWM") signal to the output of the voltage regulator. The PWM signal can modulate the average sink current at the output of the voltage regulator, thereby modifying the analog voltage level on the 0-10 V control bus. A controllable ballast or driver can be current limited. For example, the American National Standards Institute ("ANSI") standard for lamp ballasts C82.11 specifies a current limit range from 10 microamps to 2 milliamps provided by a controllable ballast. Modulating the load current across the output of the voltage regulator can control the current sinking by the voltage regulator based on the duty cycle of the PWM signal. Modifying the sinking of current can modify a control voltage on the control bus.

A controllable ballast or driver can measure the analog voltage level on the control bus or other control interface. The controllable ballast or driver can modify or control an amount of power delivered to a lamp or other lighting device based on the analog voltage level on the control bus. The relationship between the 0-10 V control voltage and light output from the lamp can be linearly proportional. A dimming curve can be predefined in a memory device of the controllable ballast or driver such that the control voltage and the light output from the lamp or other lighting device satisfy user expectations.

These illustrative examples are given to introduce the general subject matter discussed herein and are not intended to limit the scope of the disclosed concepts. The following sections describe various additional aspects and examples with reference to the drawings in which like numerals indicate like elements.

The features discussed herein are not limited to any particular hardware architecture or configuration. A computing device can include any suitable arrangement of components that provide a result conditioned on one or more inputs. Suitable computing devices include multipurpose microprocessor-based computer systems accessing stored software that programs or configures the computing system from a general-purpose computing apparatus to a specialized computing apparatus implementing one or more aspects of the present subject matter. Any suitable programming, scripting, or other type of language or combinations of languages may be used to implement the teachings contained herein in software to be used in programming or configuring a computing device.

FIG. 1 illustrates an example control device 100 for controlling a controllable ballast or driver 108. The control device 100 can include a power supply 102, a processing module 104, and a control module 106.

The control device 100 can modify an analog control voltage 109 (indicated by a bidirectional arrow) across leads 110*a*, 110*b* of a control interface, such as a 0-10 V control bus. For example, the lead 110*a* can be connected to the positive lead on a 0-10 V control interface (e.g., a violet wire) and the lead 110*a* can be connected to the negative lead on the 0-10 V control interface (e.g., a gray wire).

The analog control voltage 109 can be modified to configure the controllable ballast or driver 108. Configuring the controllable ballast or driver 108 can include modifying the output voltage provided by the controllable ballast or driver 108 based on the control voltage 109. For example, a control voltage 109 can be provided on the control bus ranging from a sum of the regulated output voltage of the power supply 102 and a minimum drop-out voltage of a specific power regulator of the power supply 102 to ten volts (e.g., 4.3 Vdc to 10 Vdc). The power or current provided to a load device 112, such as a lamp or other lighting device, from the controllable ballast or driver 108 can be adjusted proportionally with the control voltage 109. For example, an analog control voltage 109 of five volts can cause the controllable ballast or driver 108 to provide 50% of its full output power to a load device 112, such as a lamp or other lighting device.

A non-limiting example of a controllable ballast or driver 108 is a dimming ballast. The controllable ballast or driver 108 can be powered via input power leads 111*a*, 111*b*. The input power leads 111*a*, 111*b* can be respectively connected to, for example, a hot line and neutral line, a 120 V line and a neutral line, or a 277 V line and a neutral line. The output voltage, output current, or output power provided by the controllable ballast or driver 108 can be modified by any suitable mechanism, such as (but not limited to) phase dimming, current regulation, voltage regulation, power regulation, pulse-width modulation, and the like. The controllable ballast or driver 108 can provide power to a load device 112. Non-limiting examples of a load device 112 can include lighting devices, such as LEDs, HID lamps, and fluorescent lighting sources. In some aspects, the control device 100, the controllable ballast or driver 108, and the load device 112 can be included in a single device or be coupled to a single printed circuit board.

The control voltage 109 can be modified by the control module 106. The control module 106 can include a signal generator 118. The signal generator 118 can provide a driving signal 107 (as indicated by the rightward arrow) to the power supply 102. The driving signal 107 can cause the control voltage 109 to change. In some aspects, the signal generator 118 can be a PWM signal generator configured to provide a PWM signal, as discussed in detail below with respect to FIG. 2. In other aspects, the signal generator 118 can be a digital-to-analog converter of a microprocessor configured to provide an analog voltage for controlling the loading on a 0-10 V control bus.

The processing module 104 can configure the control module 106. The processing module 104 can include any suitable device or group of devices configured to execute code stored on a computer-readable medium. Examples of processing module 104 include a microprocessor, a mixed signal microcontroller, an application-specific integrated circuit ("ASIC"), a field-programmable gate array ("FPGA"), or other suitable processor. The processing module 104 can determine a frequency for the driving signal 107 provided by a signal generator 118 of the control module 106. The processing module 104 can configure the signal generator 118 to provide the driving signal 107 with the determined frequency.

The control device 100 can receive power via a connection to the leads 110*a*, 110*b* of the control interface. Powering the control device 100 via the connection to the leads 110*a*, 110*b* of a control interface such as a 0-10 V control bus can obviate the need for a separate power supply to provide power to the control device 100.

The processing module 104 can operate at a full power or other operational mode during periods of time when the control module 106 is being configured. The processing module 104 can operate in a "sleep" or other low power mode during other periods of time. The internal timing device 120 can be used to activate the processing module 104 for configuring the control module 106. Activating the processing module 104 can include switching the processing module 104 from a "sleep" or other lower power mode to a full power or other operational mode. Non-limiting examples of an internal timing device 120 can include a watch crystal oscillator, an internal very-low-power low-frequency oscillator, and an internal digitally controlled oscillator.

In some aspects, the processing module 104 can be set to a "sleep" or other low power mode for the majority of the operational lifespan of the control device 100. The processing module 104 can be set to an operational mode to latch the output of the control module 106 to a high state or a low state and determine a duty cycle for the driving signal 107. In additional or alternative aspects, the processing module 104 can read additional inputs, such as the control voltage 109 at the output of the power supply 102, to determine the duty cycle. Non-limiting examples of additional inputs may include a temperature measured by a temperature sensing device or an external switch that might be used for bi-level control. The processing module 104 can return to a sleep mode upon latching the control module 106 to a high state or a low state. The control module 106 can continue to generate a driving signal 107 as the processing module is in a sleep mode. Operating the processing module 104 in a "sleep" or other low power mode can reduce the amount of power that the control device 100 receives from the control interface.

The control device 100 can consume a sufficiently low amount of current from a control bus such that the control voltage is not affected. For example, if the controllable ballast or driver 108 is sourcing 100 microamps at 10 V, the average current consumption of the control device 100 may not exceed 10 microamps at 10 V maximum output voltage on the control bus. In another example, if the control device 100 consumes 60 microamps such that the analog control voltage is regulated at 5.0 Vdc, the controllable ballast or driver 108 can control the lamp output at 50% light output.

Figure 2:
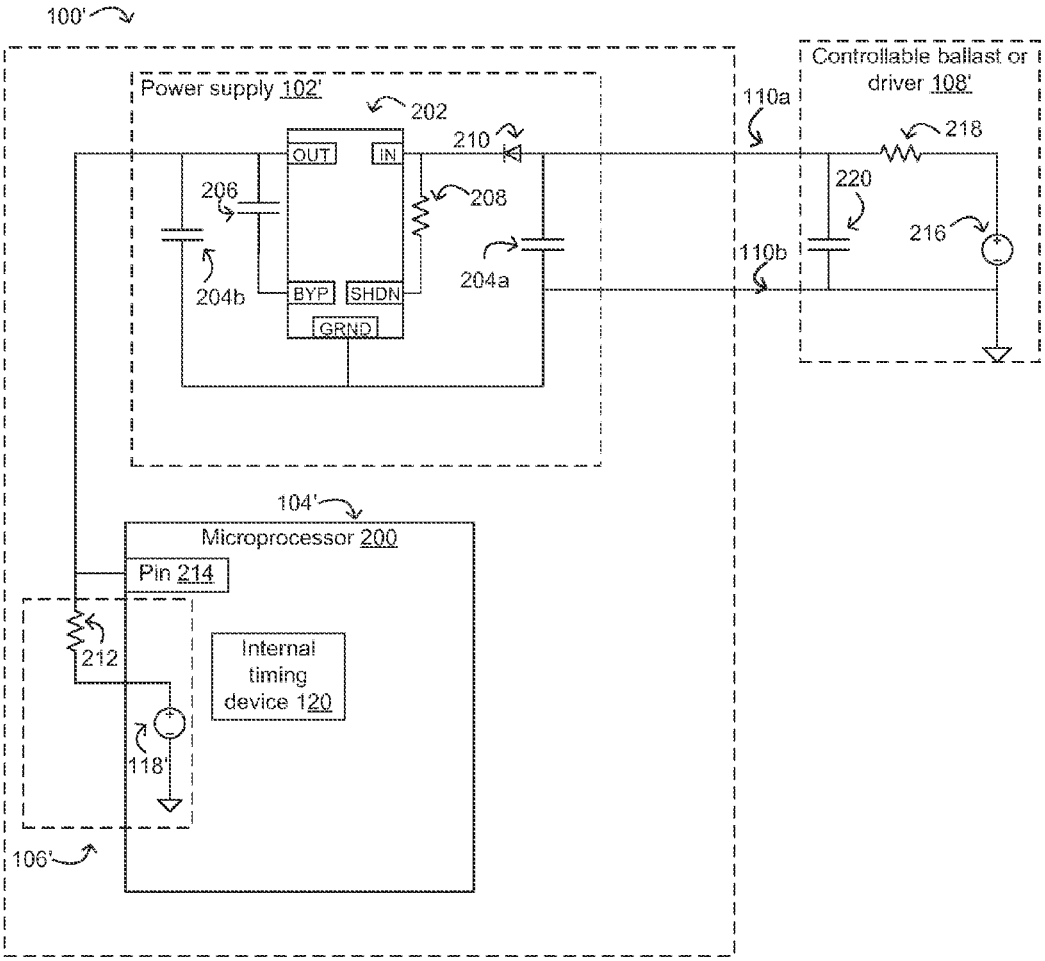
FIG. 2 is a schematic diagram illustrating the example lighting control device.

An example of a control device 100' is illustrated in the schematic diagram of FIG. 2. The control device 100' can include the power supply 102' and a microprocessor 200 that includes a processing module 104' and a control module 106'. The control device 100' can configure a controllable ballast or driver 108', such as a voltage source 216 in series with an R-C network including a resistor 218 and a capacitor 220.

The power supply 102' can include a regulator device 202, holdup capacitors 204*a*, 204*b*, and a blocking diode 210. The regulating device 202 can regulate power, current, or voltage. The regulator device 202 can step down an analog control voltage 109 provided via a control interface, such as a 0-10 V control bus. For example, a voltage of 10 V from the control interface can be stepped down to 3.3 V on the output of the regulator device 202. The voltage on the output of the regulator device 202 can power the microprocessor 200. A non-limiting example of the regulator device 202 is a low noise micro-power regulator, such as an LT® 1761 100 mA low noise micro-power regulator or a Texas Instruments® TPS75133 low-dropout regulator. A resistor 208 can couple the shutdown pin ("SHDN") of the regulator device 202 to the input pin ("IN") of the regulator device 202, thereby disabling the shutdown pin. A bypass capacitor 206 can couple the output pin ("OUT") to the bypass pin ("BYP"), thereby lowering the noise on the output voltage at the output pin. The blocking diode 210 can prevent a reverse current flow into the control bus and controllable ballast or driver 108. Other non-limiting examples of a regulator device 202 can include a voltage regulator, a linear regulator, a switched-mode power supply, or a low power regulator.

The microprocessor 200 can be any suitable low power microprocessor, such as (but not limited to) a Texas Instruments® MSP430G2231. In some aspects, the microprocessor 200 can be powered by a voltage of 0.8 V to 5.0 V. The power supply 102' can provide a regulated, constant voltage to the microprocessor 200. The voltage provided to the microprocessor 200 can be, for example, 3.3 Vdc or 5.0 Vdc. As depicted in FIG. 2, power from the control interface can be provided to the microprocessor 200 via an output pin of the regulator device 202 that is connected to a power pin 214 of the microprocessor 200.

The control module 106' can include a PWM signal generator 118' in series with a resistor 212. The PWM signal generator 118' can provide a driving signal 107 to the power supply 102'. The driving signal 107 can modulate the control voltage 109 provided by the power supply 102' via PWM.

Modulating the control voltage 109 via PWM can include providing a driving signal 107 switching between an "ON" and "OFF" state. A longer duration of the "ON" state can correspond to a higher duty cycle for the driving signal 107. The duty cycle of the PWM signal generator 118' can include a ratio of the duration of an "ON" state to the total period of the driving signal 107. Modulating the control voltage 109 using the driving signal 107 can cause current from the holdup capacitors 204*a*, 204*b* to sink. The sinking of current from the holdup capacitors 204*a*, 204*b* can modify the control voltage 109 at the output of the power supply 102'. For example, sinking 50 microamps of current can result in a control voltage 109 of 6 V and sinking 60 microamps of current can result in a control voltage 109 of 5.5 V. Modifying the duty cycle of the driving signal 107 modulating the control voltage 109 can modify the amount of current sinking, thereby modifying the control voltage 109 provided to the controllable ballast or driver 108'.

Figure 3:
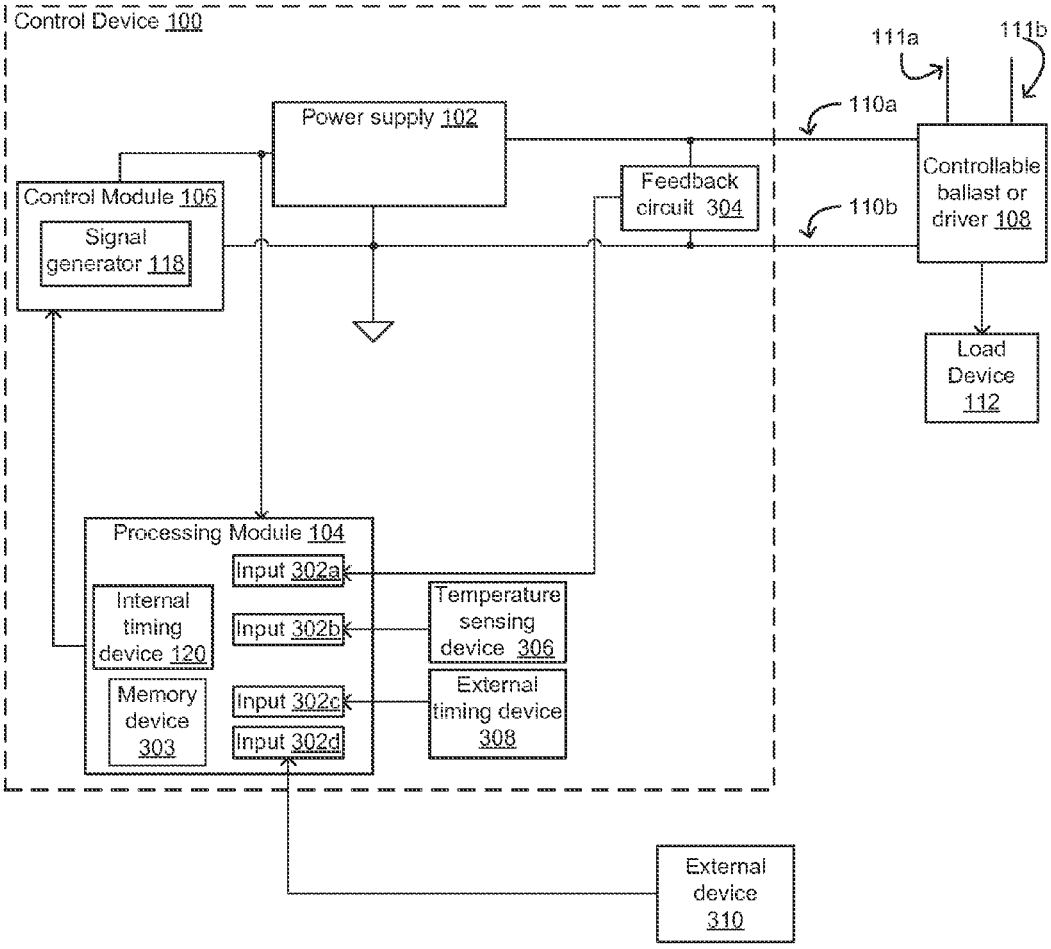
FIG. 3 is a block diagram illustrating an example lighting control device including additional devices for determining the duty cycle of a driving signal.
Figure 4:
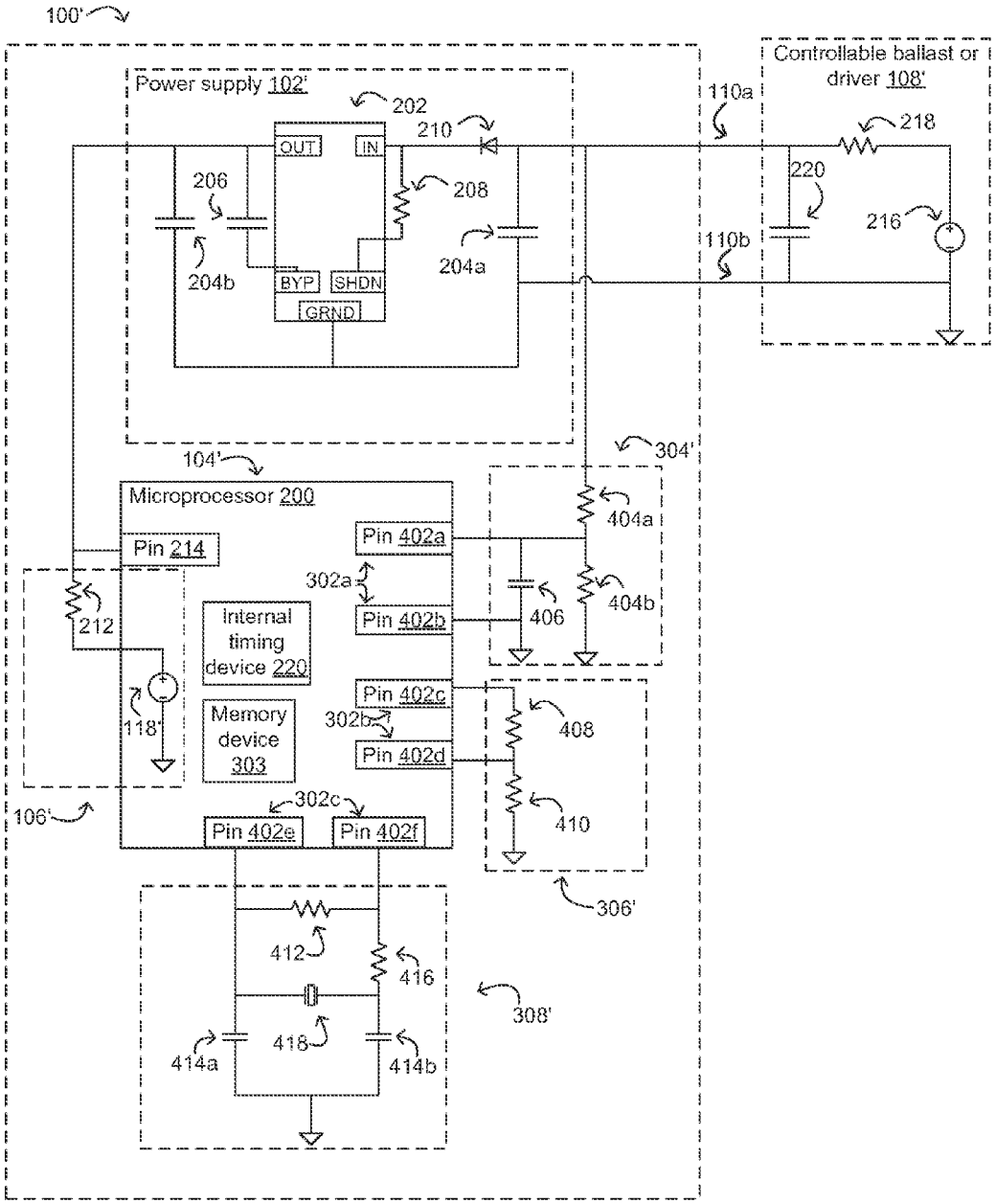
FIG. 4 is a schematic diagram illustrating the example lighting control device including additional devices.

In additional or alternative aspects, the processing module 104 can select the duty cycle of the driving signal 107 based on one or more optional inputs from additional devices. FIG. 3 is a block diagram depicting the control device 100 receiving input from additional devices such as a feedback circuit 304, a temperature sensing device 306, an external timing device 308, and an external device 310 separate from the control device 100. FIG. 4 is a schematic diagram depicting example implementations of such devices.

As depicted in FIG. 3, the processing module 104 can include inputs 302*a-d*. The inputs 302*a-d* can be respectively coupled to one or more of the feedback circuit 304, the temperature sensing device 306, the external timing device 308, and the external device 310. Although FIG. 3 depicts the control device 100 coupled to all of the feedback circuit 304, the temperature sensing device 306, the external timing device 308, and the external device 310, the control device 100 can be coupled to any number of such devices (including none).

The feedback circuit 304 depicted in FIG. 3 can be used by the processing module 104 to monitor the control voltage 109 regulated by the control device 100. The processing module 104 can measure the control voltage 109 via the feedback circuit 304. The processing module 104 can determine whether the control voltage 109 differs from a target control voltage. The target control voltage can be stored in a computer-readable medium included in or accessible by the processing module 104. The processing module 104 can modify the duty cycle of the driving signal 107 such that control voltage 109 matches the target control voltage.

A non-limiting example of feedback circuit 304' is schematically depicted in FIG. 4. The feedback circuit 304' can include resistors 404*a*, 404*b* and a capacitor 406. The input 302*a* can include the pins 402*a* of the microprocessor 200. The pin 402*a* can be, for example, an ADC input pin of the microprocessor 200. The pin 402*b* can provide a ground connection for the microprocessor 200. The microprocessor 200 can read the target control voltage from a memory device 303. The microprocessor 200 can compare the target control voltage from the memory device 303 to the sampled voltage on the pin 402*a*. The microprocessor 200 can configure the PWM signal generator 118' to adjust the PWM duty cycle based on the difference between the target voltage and the sampled voltage on the pin 402*a*.

The temperature sensing device 306 depicted in FIG. 3 can be used by the processing module 104 to monitor the ambient temperature of the control device 100. The temperature sensing device 306 can be coupled to the processing module 104 via the input 302*b*. A non-limiting example of a temperature sensing device 306' is schematically depicted in FIG. 4. The temperature sensing device 306' can include a thermistor 408 and a voltage divider resistor 410. The microprocessor 200 can monitor a temperature by providing a voltage to thermistor 408 and the voltage divider resistor 410.

Although the temperature sensing device 306 is depicted in FIG. 3 as internal to the control device 100, the temperature sensing device 306 may additionally or alternatively be an external device connected to the control device 100 via an input 302*b*. An external temperature sensing device can be used to measure the ambient temperature or direct temperature of the controllable ballast or driver 108 or a load device 112, such as a lamp or other lighting device.

The external timing device 308 depicted in FIG. 3 can provide an accurate clock signal used for real time clock monitoring. The external timing device (crystal or oscillator) can provide a clock signal used by a microcontroller to operate and calculate the real time. Non-limiting examples of an external timing device 308 can include a watch crystal oscillator, a very-low-power low-frequency oscillator, and a digitally controlled oscillator. The external timing device 308 can also be used to update the internal timing device 120. In some aspects, the external timing device 308 can use less power than internal timing device 120, thereby allowing a wider dimming range.

A non-limiting example of an external timing device 308' is schematically depicted in FIG. 4. The external timing device 308' can be a real time crystal oscillator that includes a crystal 418, such as (but not limited to) an ECS-3X8 crystal, connected to ground via the capacitors 414*a*, 414*b*. The real time crystal oscillator can also include a feedback resistor 412 and a series resistor 416. The external timing device 308' can be used as a reference for the internal timing device 120 for monitoring the operating time of the fixture. The external timing device 308' can be coupled to the microprocessor 200 via an input 302*c* such as pins 402*e*, 402*f*. Non-limiting examples of the pins 402*e*, 402*f* can include a timing input pin, such as the "XIN" pin of a microcontroller, and a timing output pin, such as the "XOUT" pin of a microcontroller.

In additional aspects, the control device 100 can use one or more of the operating time, ambient temperature, or data provided by the external device 310 to compensate for lumen depreciation in a load device 112 that is a lighting device. For example, luminaires having light emitting diodes ("LED", high-intensity discharge ("HID") lamps, and fluorescent lighting sources can reduce light output by 20% or more over their useful lifespan. The controllable ballast or driver 108 can provide additional power to a load device 112 to compensate for lumen depreciation. A compensating control voltage can be provided to the controllable ballast or driver 108 to configure the controllable ballast or driver 108 to provide the additional power. The processing module 104 of the control device 100 can determine the compensating control voltage using one or more of the operating time, ambient temperature, or data provided by the external device 310, thereby increasing the power provided to the load device 112.

The operating time for the control device 100 can be used by the processing module 104 to determine the compensating control voltage outputted by the power supply 102 and an appropriate duty cycle for the driving signal 107 provided by the control module 106. The compensating control voltage can increase in relation to the operating time for the control device 100. For example, the processing module 104 can select a duty cycle sufficient to configure the power supply 102 to provide a control voltage of 8.2 V at 10,000 operating hours and a control voltage of 9.3 V at 50,000 operating hours.

The control device 100 can increase the control voltage 109 over time to compensate for lumen depreciation in a load device 112 that is a lighting device. A device profile specific to the load device 112 can be stored in a memory device included in or accessible by the control device 100. The device profile can include an estimated lumen depreciation over time for a given lighting device. The processing module 104 can access the device profile and determine a compensating control voltage based on the device profile and the operating time. In some aspects, the control device 100, controllable ballast or driver 108, and load device 112 can be included in a low power lighting system. The low power lighting system can thus provide a continuous light output level for the expected lifetime of the load device 112.

The temperature sensing device 306 can be used to provide additional information regarding lumen depreciation. For example, the lumen depreciation for a load device 112 that is a lighting device can differ based on the ambient temperature or the temperature of components of the load device 112. For environments in which the control device 100 and the load device 112 have similar ambient temperatures, the processing module 104 can determine a target control voltage for the power supply 102 based on the ambient temperature detected by the temperature sensing device 306. The control device 100 can increase the control voltage 109 to compensate for lumen depreciation based on the ambient temperature exceeding a threshold temperature.

In additional or alternative aspects, an external device 310 that is a temperature sensor disposed in the load device 112 can be used to provide the ambient temperature or the temperature of components of the load device 112. The processing module 104 can determine a target control voltage for the power supply 102 based on the temperature provided by the external device 310. The control device 100 can increase the control voltage 109 to compensate for lumen depreciation based on the temperature exceeding a threshold temperature.

In additional or alternative aspects, an external device can be a second control device, such as (but not limited to) a 0-10 V analog control dimmer. The second control device can be connected to the controllable ballast or driver 108 in parallel with the control device 100. The second control device can allow the output of the controllable ballast or driver 108 to be manually controlled.

Figure 5:
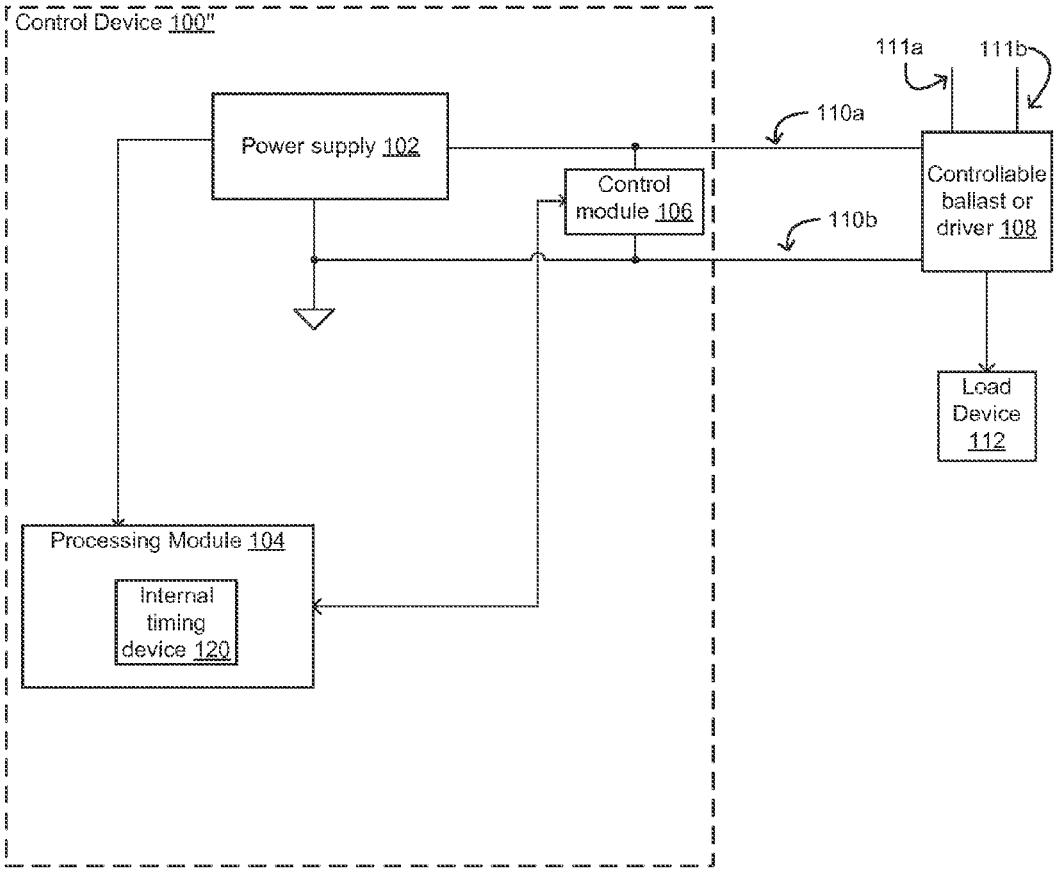
FIG. 5 is a block diagram illustrating an alternate example of a lighting control device.

In additional or alternative aspects, the control module 106 can be positioned at the input of the power supply 102. FIG. 5 depicts a block diagram of a control device 100" having a control module 106 positioned at the input of the power supply 102. The control module 106 can modify the control voltage 109 that is used to control the power output to the load device 112 provided by the controllable ballast or driver 108.

Figure 6:
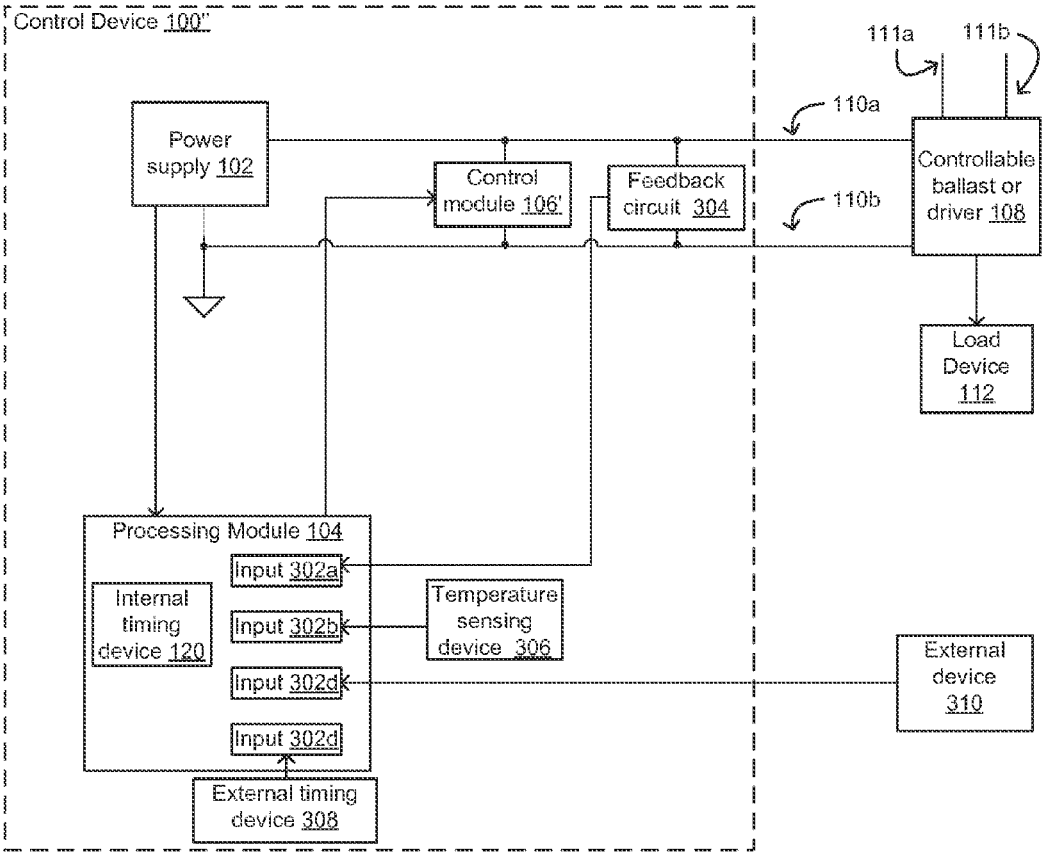
FIG. 6 is a block diagram illustrating the alternate lighting control device including additional devices.

In additional or alternative aspects, the control device 100" can include additional devices. For example, FIG. 6 depicts a control device 100" having the feedback circuit 304, the temperature sensing device 306, the external timing device 308, and the external device 310. Non-limiting examples of the feedback circuit 304, the temperature sensing device 306, the external timing device 308 depicted in FIG. 6 can respectively include the feedback circuit 304', the temperature sensing device 306', the external timing device 308' depicted in FIG. 4.

Figure 7:
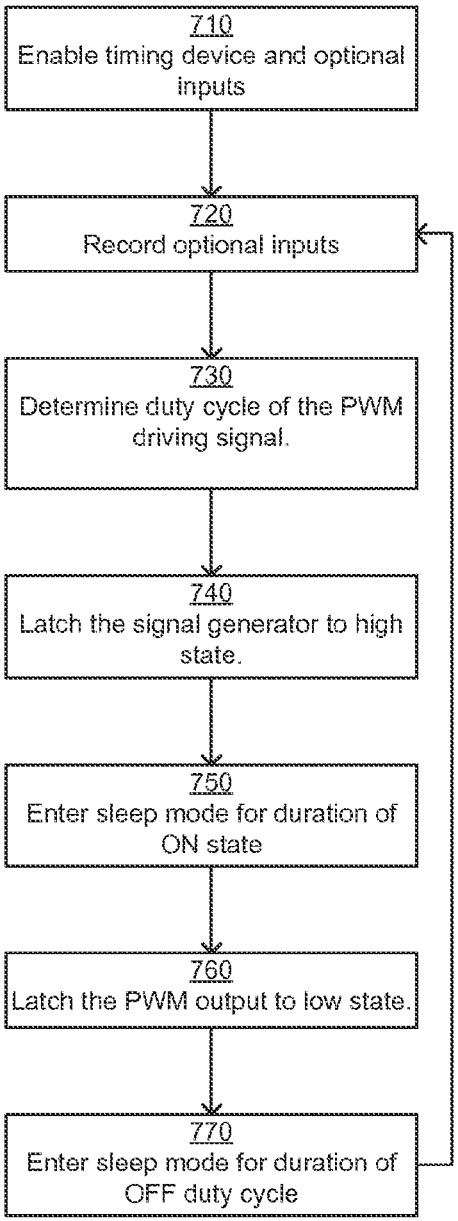
FIG. 7 is a flow chart illustrating an example method of determining the duty cycle of a driving signal generated by a control module of the lighting control device.

The processing module 104 can iteratively determine a duty cycle for the driving signal 107 based on data provided by or generated from the additional devices included in or connected to the control device 100. FIG. 7 is a flow chart illustrating an example method 700 of determining the duty cycle of a driving signal 107 provided by the control module 106. For illustrative purposes, the method 700 is described with reference to the system implementation depicted in FIGS. 1-4. Other implementations, however, are possible.

The exemplary method 700 involves enabling a timing device and one or more of the inputs 302*a-d* of the control device 100, as shown in block 710. The timing device can be the internal timing device 120. In additional aspects, the external timing device 308 can also be enabled.

The exemplary method 700 further involves recording one or more of the inputs 302*a-d* to the memory device 303, as shown in block 720. The processing module 104 can record the inputs 302*a-d*. The one or more inputs 302*a-d* can include data received by or determined using the feedback circuit 304, the temperature sensing device 306, and the external device 310. The inputs 302*a-d* can be used to implement features such as lumen depreciation compensation and real operation time duration.

The exemplary method 700 further involves determining the duty cycle of the driving signal 107 provided by the control module 106, as shown in block 730. The processing module 104 can determine the duty cycle of the driving signal 107. Determining the duty cycle of the driving signal 107 can include calculating the duration of the ON state of a driving signal 107 provided by the signal generator 118 of the control module 106. A non-limiting example of the driving signal 107 is a PWM driving signal generated by a PWM signal generator 118'. The processing module 104 can determine the duty cycle based on the inputs 302*a-d*. In additional or alternative aspects, the processing module 104 can determine the duty based on a look-up table of target control voltages provided by the power supply 102. Latch the PWM output to high state.

The exemplary method 700 further involves latching the output of the signal generator 118 to a high state, as shown in block 740. The processing module 104 can communicate a control signal to the control module 106. The control module 106 can latch the signal generator 118 to a high state in response to receiving the control signal from the processing module 104.

The exemplary method 700 further involves the processing module 104 entering a sleep or other low-power mode for the duration of the ON state, as shown in block 750. Entering the sleep or other low-power mode can conserve power used by the control device 100. The internal timing device 120 and/or the external timing device 308 can cause the processing module 104 to exit the sleep or other low-power mode and enter an operational mode after the duration of the ON state.

The exemplary method 700 further involves latching the output of the signal generator 118 to a low state, as shown in block 760. The processing module 104 can communicate a control signal to the control module 106. The control module 106 can latch the signal generator 118 to a low state in response to receiving the control signal from the processing module 104.

The exemplary method 700 further involves the processing module 104 entering a sleep or other low-power mode for the duration of the OFF state, as shown in block 770. Entering the sleep or other low-power mode can conserve power used by the control device 100. The internal timing device 120 and/or the external timing device 308 can cause the processing module 104 to exit the sleep or other low-power mode and enter an operational mode after the duration of the OFF state. The method 700 can return to block 720 to determine the duty cycle for the driving signal 107.

The foregoing is provided for purposes of illustrating, describing, and explaining aspects of the present invention and is not intended to be exhaustive or to limit the invention to the precise forms disclosed. Further modifications and adaptation to these embodiments will be apparent to those skilled in the art and may be made without departing from the scope and spirit of the invention.

What is claimed is:

1. A control device comprising:

a control module configured to provide a driving signal, wherein the driving signal is configured to modify a control voltage on a control interface, wherein the control voltage is configured to control a controllable ballast or driver powering a lighting device; and a processing module configured to determine a duty cycle of the driving signal;

wherein the control module and the processing module are configured to receive power via the control interface.

2. The control device of claim 1, wherein the control interface comprises a 0-10 volt analog control bus.

3. The control device of claim 1, wherein the control module and the processing module are included in a low-power microprocessor.

4. The control device of claim 3, further comprising a regulating device, wherein the regulating device is configured to modify the control voltage by sinking a current provided via the control interface, wherein the driving signal is configured to control the sinking of the current by modulating a load current of the regulating device.

5. The control device of claim 4, wherein the regulating device comprises at least one of a voltage regulator, a linear regulator, a switched-mode power supply, or a low power regulator.

6. The control device of claim 3, wherein the control module comprises a pulse-width modulation signal generator.

7. The control device of claim 3, wherein the control module comprises a digital-to-analog converter of the low-power microprocessor, the digital-to-analog converter configured to provide the driving signal to the control interface, wherein the driving signal comprises an analog signal.

8. The control device of claim 1, further comprising a feedback circuit coupled to the control interface and the processing module, wherein the feedback circuit is configured to detect the control voltage of the control interface at an output of the control device.

9. The control device of claim 8, further comprising a temperature sensing device configured to measure an ambient temperature of at least one of the lighting device or the control device.

10. The control device of claim 9, wherein the processing module is configured to execute operations comprising:

receiving one or more inputs comprising one or more of the control voltage detected by the feedback circuit, the ambient temperature, and data provided by a device external to the control device;

determining the duty cycle based on the one or more inputs;

latching the control module to a high state;

entering a sleep mode for a first duration corresponding an "ON" state of the duty cycle;

latching the control module to a low state; and entering the sleep mode for a second duration corresponding to an "OFF" state of the duty cycle.

11. The control device of claim 9, further comprising an external timing device configured to provide a clock signal to the processing module, wherein the processing module is configured to determine an operating time using the clock signal, wherein the operating time comprises a duration that the control module is operational.

12. The control device of claim 11, wherein the processing module is configured to:

determine a lumen depreciation of the lighting device based on the operating time and the ambient temperature;

determine a compensating control voltage corresponding to a power level provided by the controllable ballast or driver, wherein the power level is correlated with the lumen depreciation; and determine the duty cycle based on the compensating control voltage.

13. A lighting system comprising:

a lighting device;

a controllable ballast or driver configured to provide power to the lighting device; and a control device comprising:

a control module configured to provide a driving signal, wherein the driving signal is configured to modify a control voltage on a control interface, wherein the control voltage is configured to control the controllable ballast or driver, and a processing module configured to determine a duty cycle of the driving signal, wherein the control module and the processing module are configured to receive power via the control interface.

14. The lighting system of claim 13, wherein the control interface comprises a 0-10 volt analog control bus.

15. The lighting system of claim 13, wherein the controllable ballast or driver is configured to modify the power provided to the lighting device based on the control voltage.

16. The lighting system of claim 13, wherein the processing module is configured to determine the duty cycle of the driving signal based on a lumen depreciation of the lighting device.

17. The lighting system of claim 16, further comprising:

a timing device configured to provide a clock signal to the processing module; and a temperature sensing device configured to measure a temperature of one or more components of the lighting device;

wherein the processing module is further configured to:

determine an operating time of the lighting device using the clock signal;

determine the lumen depreciation based on the operating time and the temperature.

18. A control device configured to modify a control voltage provided via a control interface to a controllable ballast or driver, the control device comprising:

a regulating device; and a microprocessor configured to receive power via the control interface and further configured to modify the control voltage by:

determining a duty cycle of a driving signal, wherein the driving signal is configured to modulate a load current of the regulating device; and providing the driving signal to the regulating device.

19. The control device of claim 18, wherein the regulating device comprises at least one of a linear regulator, a switched-mode power supply, or a low power regulator.

20. The control device of claim 18, wherein the control interface comprises a 0-10 volt analog control bus.

21. The control device of claim 18, wherein the microprocessor comprises a digital-to-analog converter configured to provide the driving signal to the control interface, wherein the driving signal comprises an analog signal.

22. The control device of claim 18, further comprising a feedback circuit configured to detect the control voltage at an output of the control device, wherein the microprocessor is configured to modify the duty cycle based on the control voltage at the output of the control device.

23. The control device of claim 22, further comprising a temperature sensing device configured to measure an ambient temperature of at least one of the control device or a lighting device powered by the controllable ballast or driver, wherein the microprocessor is further configured to modify the duty cycle based on the ambient temperature.

24. The control device of claim 23, wherein the microprocessor is further configured to execute operations comprising:

latching a signal generator configured to generate the driving signal to a high state based on the duty cycle;

entering a sleep mode for a first duration corresponding an "ON" state of the duty cycle;

latching the signal generator to a low state based on the duty cycle; and entering the sleep mode for a second duration corresponding to an "OFF" state of the duty cycle.

* * * * *